US011987973B2

(12) United States Patent
Cross et al.

(10) Patent No.: US 11,987,973 B2
(45) Date of Patent: May 21, 2024

(54) VISUAL AND AUDITORY REDUCING ENCLOSURE

(71) Applicant: Princeton Leadership Services LLC, State College, PA (US)

(72) Inventors: Michael Cross, State College, PA (US); Aidan Cross, State College, PA (US); Nathan Cross, State College, PA (US); Erica Rummel, Wycombe, PA (US); Chris Welde, Newtown, PA (US)

( * ) Notice: Subject to any disclaimer, the term of this patent is extended or adjusted under 35 U.S.C. 154(b) by 726 days.

(21) Appl. No.: 17/096,731

(22) Filed: Nov. 12, 2020

(65) Prior Publication Data

US 2021/0140170 A1 May 13, 2021

Related U.S. Application Data

(60) Provisional application No. 62/934,622, filed on Nov. 13, 2019.

(51) Int. Cl.

| | |
|---|---|
| ***E04B 1/343*** | (2006.01) |
| ***A63B 71/02*** | (2006.01) |
| ***E04B 1/344*** | (2006.01) |
| ***E04H 1/12*** | (2006.01) |

(52) U.S. Cl.

CPC ..... *E04B 1/343* (2013.01); *A63B 71/02* (2013.01); *E04B 1/34384* (2013.01); *E04B 1/3442* (2013.01); *E04H 1/125* (2013.01); *A63B 2210/50* (2013.01)

(58) Field of Classification Search

CPC .... E04B 1/343; E04B 1/34384; E04B 1/3442; E04B 1/34305; E04H 1/125; A63B 71/02; A63B 2210/52; A63B 2210/50

See application file for complete search history.

(56) References Cited

U.S. PATENT DOCUMENTS

| | | | | |
|---|---|---|---|---|
| 2,923,547 | A * | 2/1960 | Heeremans | A63B 71/022 135/132 |
| 5,672,125 | A * | 9/1997 | Ross | A63B 71/022 473/421 |
| 6,319,145 | B1 * | 11/2001 | Coughlan | A63B 71/022 473/197 |
| 6,349,732 | B1 * | 2/2002 | Cooper | E04H 6/04 135/148 |
| 7,845,364 | B2 * | 12/2010 | Tolmie | E04H 15/38 135/900 |
| 8,460,128 | B2 * | 6/2013 | Elpers | A63B 69/0097 473/422 |
| 10,513,865 | B2 * | 12/2019 | Petrenko | E04H 6/025 |
| 11,199,022 | B2 * | 12/2021 | Farris | E04H 15/38 |
| 2002/0083971 | A1 * | 7/2002 | Blount | E04H 6/04 135/132 |

* cited by examiner

*Primary Examiner* — Beth A Stephan

(74) *Attorney, Agent, or Firm* — Penn State Law IP Clinic; Jackson Ellis; Jonathan D'Silva

(57) ABSTRACT

A device for eliminating auditory and visual distractions for the user. The device is adjustable and features walls comprised of fabric to accomplish its design goal. Extendable poles provide the structure for the device. The tent-like device can quickly expand into its useful position. The device can also quickly collapse. The device can be stored in a storage container for simple transportation.

20 Claims, 12 Drawing Sheets

VISUAL AND AUDITORY REDUCING ENCLOSURE

CROSS REFERENCE

This application claims the benefit of U.S. Provisional Application No. 62/934,622 filed Nov. 13, 2019, which application is incorporated herein by reference.

BACKGROUND OF THE INVENTION

During the course of live game play, sports teams may leverage timeouts to temporarily stop play. During a timeout, a team can, among other things, adjust its lineup, design a play, or, simply, rest. While in a timeout, sports teams face the challenging task of quickly and effectively communicating game strategy, while simultaneously ignoring auditory and visual distractions from the crowd and opposing team. In particular, basketball teams attempting to communicate during a timeout face significant challenges. Because opposing basketball teams are placed adjacently to one another during a game, achieving privacy from the opponent can be difficult. Beyond the opponent, television cameras, cellular phone cameras, and tablet cameras can capture coach's comments and plays drawn on chalkboards or whiteboards. Adding to these challenges, basketball teams also sit in close proximity to the crowd. In response to this combination of distractions and privacy intrusions, basketball teams have begun pulling stools away from the team bench and toward the center of the court. Once away from the opposing team and crowd, coaches can communicate with players in quasi-privacy.

The device seeks to increase privacy for basketball teams during timeouts, thereby increasing the efficiency of communication between coaches and players and, subsequently, providing the team with a competitive advantage. When not in use, the device can be collapsed and stored behind the team bench area. The device can be deployed and retracted quickly and can be deployed around the perimeter of the team bench during timeouts. The device features walls on the left and right side of the structure and a wall on the back of the structure. The front of the device remains open, allowing coaches and non-participating players to stand in front of players who will enter the game and communicate. The device's walls provide an auditory and visual barrier to the basketball team. Accordingly, the device provides basketball teams with increased privacy during timeouts.

SUMMARY OF THE INVENTION

In some embodiments the collapsible and portable barrier system comprises: a plurality of poles, comprising a right-side primary support pole and a left-side primary support pole configured to hold opaque fabric upright along a rear wall side and two or more skeletal poles configured to attach to said opaque fabric on a left side and a right side of said barrier system; a left-side pole housing; and a right-side pole housing wherein said opaque fabric increases privacy and reduces distractions for users. In one aspect the collapsible and portable barrier system further comprises a fabric that is opaque. In one aspect the collapsible and portable barrier system has a left-side pole housing and the right-side pole housing that are each comprised of a pin bracket hinge system. In one aspect the collapsible and portable barrier system has left-side and right-side walls that can be opened or closed using a pin bracket spacer. In one aspect the collapsible and portable can transform from a closed configuration to an open configuration in less than ten seconds.

In some embodiments the collapsible and portable barrier system comprises: a plurality of poles, comprising a right-side primary support pole and a left-side primary support pole configured to hold an opaque fabric upright along a rear wall side and two or more skeletal poles configured to attach to said opaque fabric on a left side and a right side of said barrier system; a left-side pole housing; and a right-side pole housing, wherein said collapsible and portable barrier system can be expanded to an open configuration from a closed configuration by a single user in ten seconds or less. In one aspect the collapsible and portable barrier system can collapse into a storage enclosure. In one aspect the storage enclosure can be comprised of wheels and one or more handles. In one aspect the collapsible and portable barrier system can be expanded to an open configuration from a close configuration by one or more users.

In some embodiments the collapsible and portable barrier system comprises: a plurality of poles, comprising a right-side primary support pole and a left-side primary support pole configured to hold an opaque fabric upright along a rear wall side and two or more skeletal poles configured to attach to said opaque fabric on a left side and a right side of said barrier system; a left-side pole housing; a right-side pole housing; an adjustable base, wherein said adjustable base can be configured to adjust the size of said collapsible and portable barrier system from between 2 meters to 3.5 meters. In one aspect the base can be secured in the desired width with a system of pins.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 4:
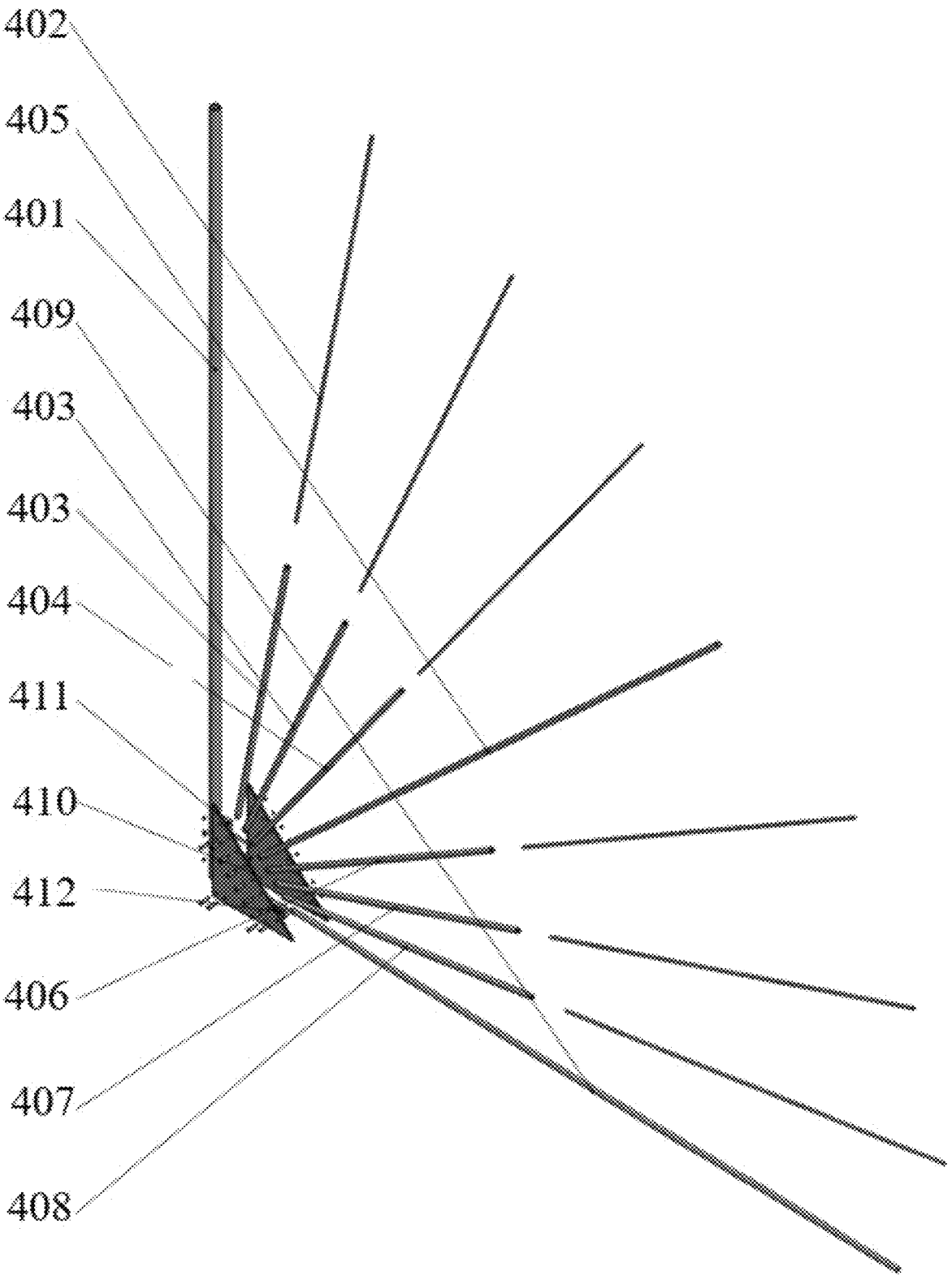
FIG. 4 is an exemplary illustration of the poles and pin bracket inside of the walls used to support the enclosure.
Figure 5:
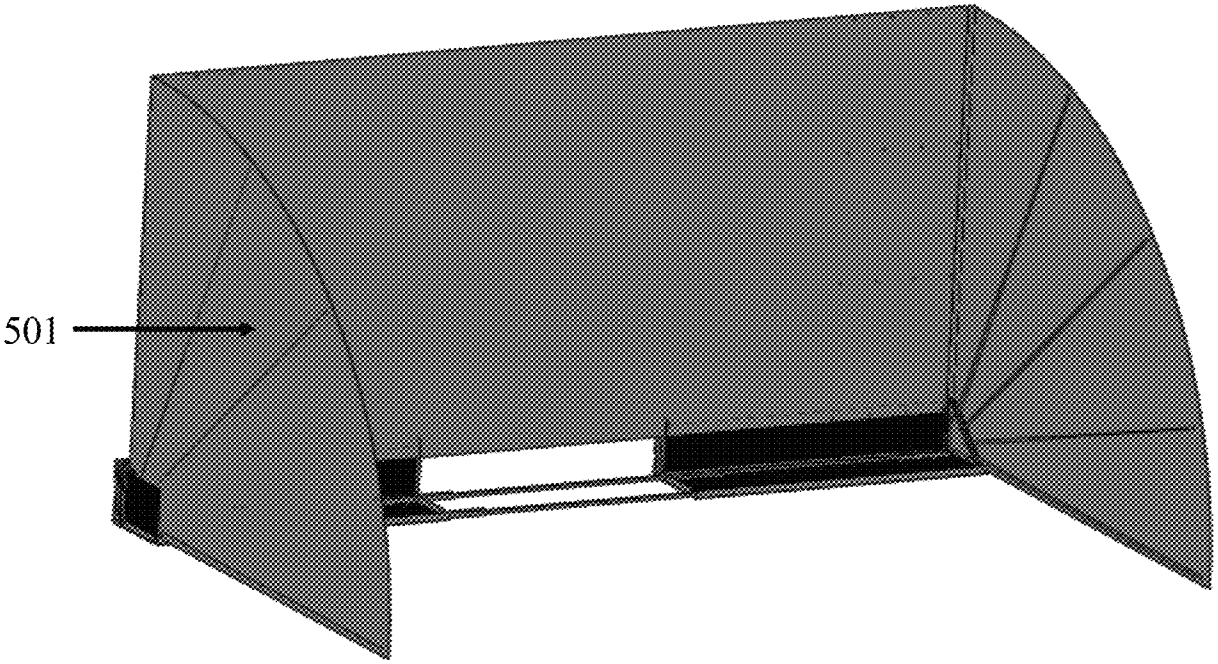
FIG. 5 is an exemplary illustration of the device in its expanded form.
Figure 6:
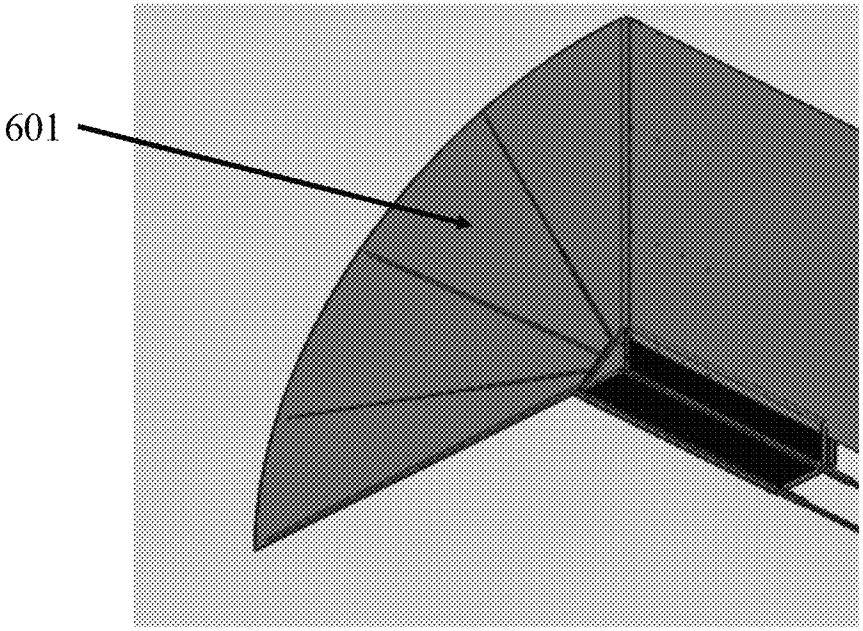
FIG. 6 is an exemplary illustration of the left wall of the device in its expanded form.
Figure 7:
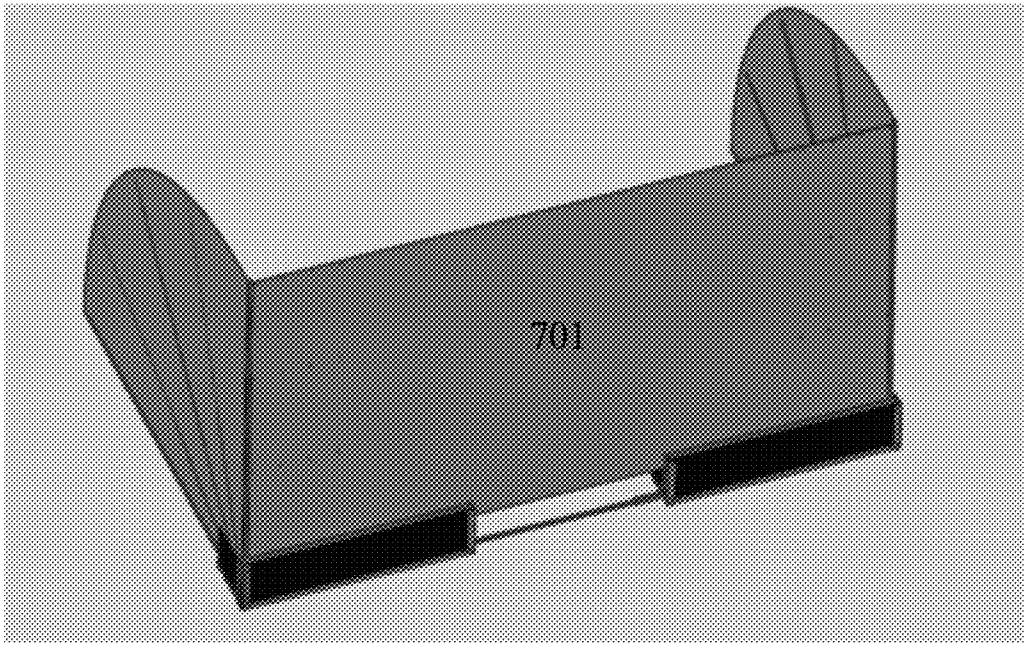
FIG. 7 is an exemplary illustration of the rear wall of the device in its expanded form.

In some embodiments, the device provides auditory and/or visual privacy for users. The auditory and/or visual privacy can be provided by opaque, sound-reducing fabric (FIG. 5). In some embodiments, the structural frame of the device is comprised of poles (FIG. 4). In some embodiments, the device consists of a rectangular rear wall (FIG. 7). In some embodiments, the left and right walls of the device are quarter-circles that can resemble a fan-like foldout (FIG. 6). In some embodiments, the front of the device is left open.

Figure 10:
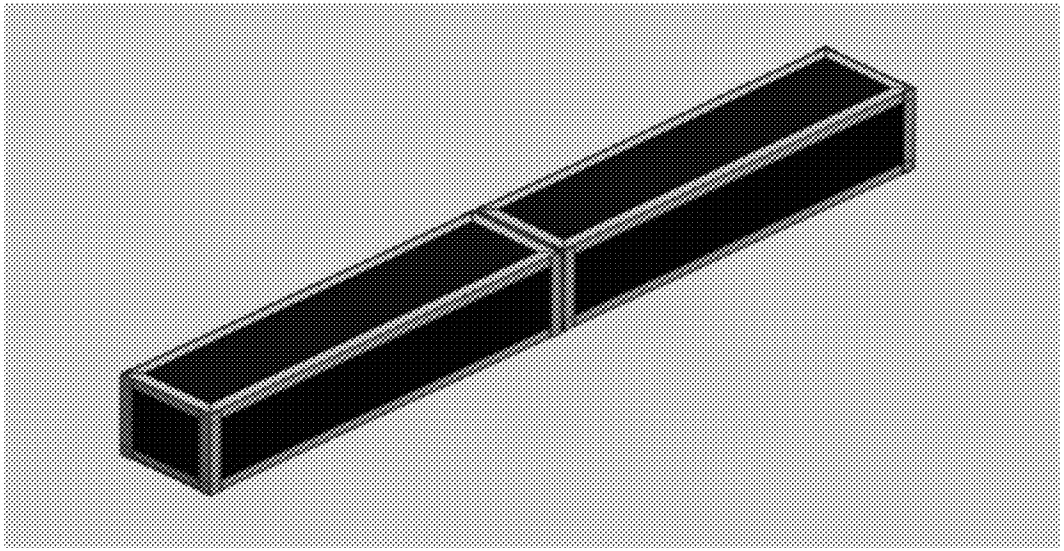
FIG. 10 is an exemplary illustration of the enclosure that houses the device in a long-term storage state.

In some embodiments, the device can be folded and stored in a portable, self-collapsing storage container (FIG. 10). The storage container can have latches that keep the structure enclosed. In some embodiments, the apparatus features a handle on both sides of the storage container. In some embodiments, the storage container has wheels. The size, shape, and features of the storage container make the device easy to store and transport.

Once the latches on the storage container are opened, the device can expand into an open configuration. Users can expand the device into its expanded form in as little as five seconds. Users begin the expansion process by erecting the primary support poles. Users can secure the poles in a desired position with a locking mechanism. Once the primary support poles are erected, the poles that support the left-side and right-side walls can expand into position under the force of gravity. The poles that support the left-side and right-side walls can also be pulled into position by the user.

In some embodiments, the walls are comprised of opaque and/or sound reducing fabric. In some embodiments, the fabric is sound reducing. In some embodiments, the fabric is not sound reducing. The fabric can be any color. The fabric can be black. The fabric can be grey. The fabric can be the team's colors. The fabric can be spandex. The fabric can be a combination of various materials. The fabric can be rayon. The fabric can be nylon.

The rear wall of the device can be rectangular in shape (FIG. 7). The rear wall can be 1.0 meter in width. The rear wall can be 1.2 meters in width. The rear wall can be 1.4 meters in width. The rear wall can be 1.6 meters in width. The rear wall can be 1.8 meters in width. The rear wall can be 2.0 meters in width. The rear wall can be 2.2 meters in width. The rear wall can be 2.4 meters in width. The rear wall can be 2.4 meters in width. The rear wall can be 2.6 meters in width. The rear wall can be 2.8 meters in width. The rear wall can be 3.0 meters in width. The rear wall can be 3.2 meters in width. The rear wall can be 3.4 meters in width. The rear wall can be 3.6 meters in width. The rear wall can be 3.8 meters in with. The rear wall can be 4.0 meters in width. The rear wall can be any width within the given range and can reasonably exceed the minimum and maximum widths provided.

The rear wall can be 1.0 meter in height. The rear wall can be 1.2 meters in height. The rear wall can be 1.4 meters in height. The rear wall can be 1.6 meters in height. The rear wall can be 1.8 meters in height. The rear wall can be 2.0 meters in height. The rear wall can be 2.2 meters in height. The rear wall can be 2.4 meters in height. The rear wall can be 2.6 meters in height. The rear wall can be 2.8 meters in height. The rear wall can be 3.0 meters in height. The rear wall can be any height within the given range and can reasonably exceed the minimum and maximum heights provided.

The left and right-side walls of the device can each resemble a quarter-circle. In some embodiments, the left and right-side walls of the device can resemble a fan-like foldout. (FIG. 6). The left and right-side walls can have a radius of approximately 1.0 meter. The left and right-side walls can have a radius of approximate 1.2 meters. The left and right-side walls can have a radius of approximate 1.4 meters. The left and right-side walls can have a radius of approximate 1.6 meters. The left and right-side walls can have a radius of approximate 1.8 meters. The left and right-side walls can have a radius of approximate 2.0 meters. The left and right-side walls can have a radius of approximate 2.2 meters. The left and right-side walls can have a radius of approximate 2.4 meters. The left and right-side walls can have a radius of approximate 2.6 meters. The left and right-side walls can have a radius of approximate 2.8 meters. The left and right-side walls can have a radius of approximate 3.0 meters. The left and right-side walls can be any radius within the given range and can reasonably exceed the minimum and maximum radii provided.

In some embodiments, both left and right-side walls are comprised of at least three support poles. In some embodiments, both left and right-side walls are comprised of nine poles (FIG. 4). In some embodiments, both left and right-side walls are comprised of as many as 12 poles. The poles can be comprised of a flexible lightweight material. The poles can be made of fiberglass. The poles can be made of aluminum. In some embodiments, the poles comprising the left and right-side walls are hollow and allow for one pole to be secured in another pole.

The poles that provide structural support for the device can be secured in a housing device. In some embodiments, the poles are held in place by a pin bracket (FIG. 4). The pin bracket can be made of aluminum. The pin bracket can be made of other materials. In some embodiments, the pin bracket is triangular in shape. In some embodiments, the pin bracket is approximately 20-30 centimeters in width and 20-30 centimeters in height.

In some embodiments, the poles can be adjusted using a pin bracket spacer (FIG. 4). In some embodiments, the pin bracket is a diagonally cut, square piece of light-weight material. The pin bracket can be aluminum. A locking mechanism can hold the pin bracket in place.

When the device is expanded, the poles can be adjusted through the use of pinholes in the pin bracket. In some embodiments, the poles are secured with nuts and bolts. In some embodiments, the poles, and thus, the wall, can be collapsed inward toward the first pole and expanded by releasing the poles (FIG. 4). The pinholes in the pin bracket can be approximately 2-3 centimeters apart along the hypotenuse of the pin bracket (FIG. 4).

To deploy the device, the primary support pole (FIG. 4) is unfolded out of the enclosure. The user deploying the device can extend either the left primary support pole or the right primary support pole first (FIG. 4). The user assembling the device will lift the flap until the primary support pole clicks into its corresponding position inside the pin bracket.

Figure 8:
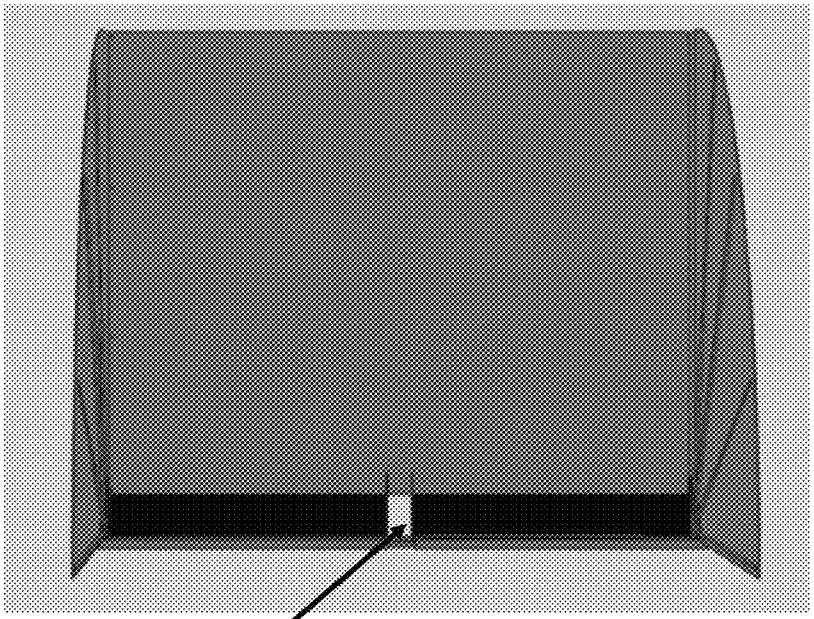
FIG. 8 is an exemplary illustration of the device in an expanded state where the base of the device is also expanded.
Figure 9:
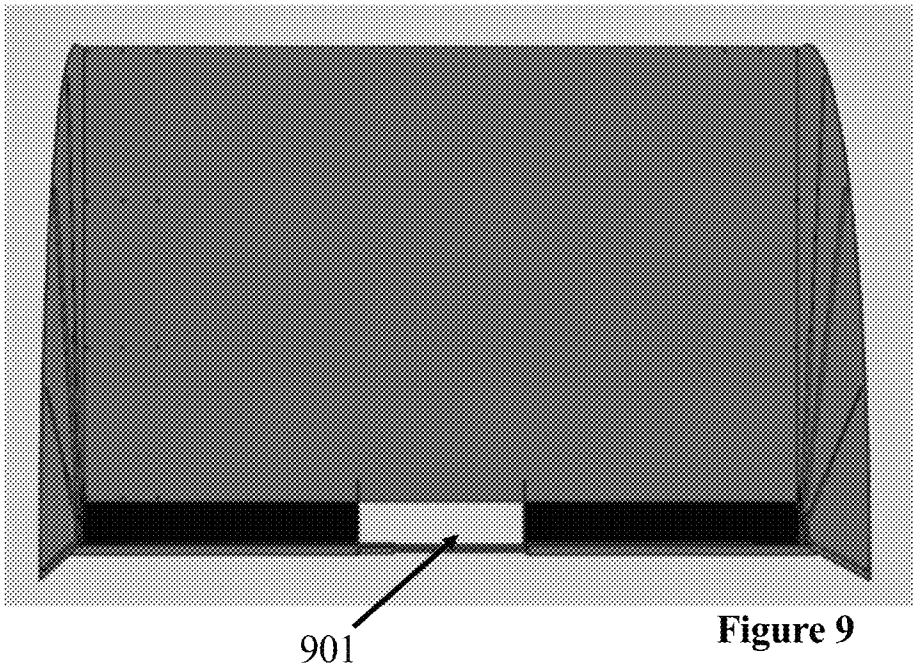
FIG. 9 is an exemplary illustration of the device in an expanded state where the base of the device is also expanded.

The base of the device, which can function as the device's storage container, can also expand to various widths (FIGS. 8-9). Once the desired width is reached, users can secure the position of the base with pins.

The device's side walls can fully expand once the main rod is completely vertical and secured into place. The side walls can expand into the shape of a quarter-circle. The side walls can resemble a fan-like foldout.

The device can be deployed in three seconds. The device can be deployed in four seconds. The device can be deployed in five seconds. The device can be deployed in six seconds. The device can be deployed in seven seconds. The device can be deployed in eight seconds. The device can be deployed in nine seconds. The device can be deployed in ten seconds. The short amount of time required to deploy the device makes the apparatus more efficient and less cumbersome than dragging chairs away from the opposing team and crowd. The device eliminates the need for a second team bench area. This saves time compared to moving the team from the bench to the center of the playing surface and assembling and disassembling stools for the athletes, coaches, and support staff to sit on. While the team is gathering on the playing surface, sweat can accumulate on the playing surface. Support staff must clean the playing surface before play can resume. Because the device is deployed behind the team bench, the time needed to clean the playing surface is avoided.

By using the device, users can avoid being distracted by opposing players, fans, on-court activities, television and other recording devices or media personnel. The structure can provide a partition between the team's bench area and the opposing team and crowd. Deployed and retracted in seconds, the device provides its users with privacy to effectively communicate.

When the stoppage in play is over, users can quickly collapse the device. First, the user can push the left and right-side walls toward primary support pole (FIG. 4). Then, the user can compress the quick-release latches located on both sides of the device, which connect the main poles to the base of the structure, and release the rods. The structure can collapse into halves that overlap in the storage container. The device can remain in this quick-deploy state. Once the user wishes to transform the device from its quick-deploy state to its long-term storage state, the user can fold the collapsible lid over the collapsed structure and secure the latches on the storage container.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

Figure 1:
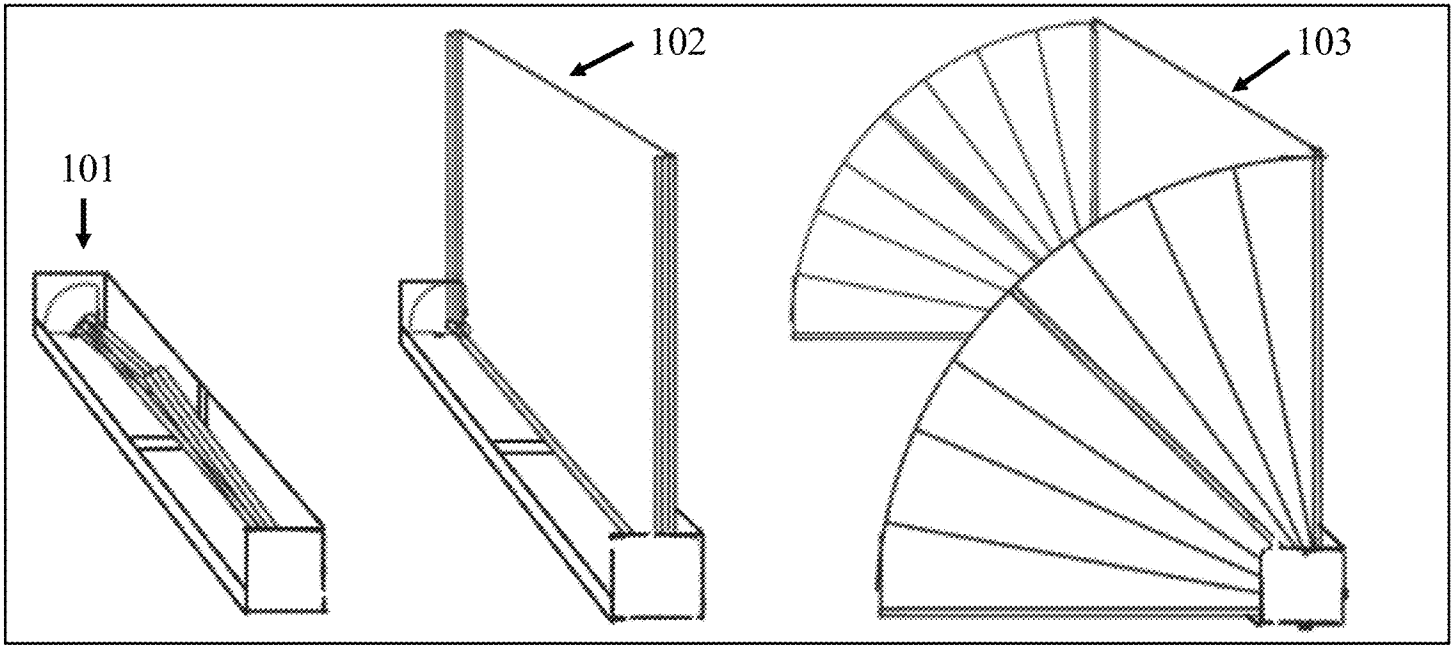
FIG. 1 is an exemplary illustration of an isometric view of the device used to enclose the team bench during timeouts or other pauses in the game.

FIG. 1 is an exemplary illustration of an isometric view of the structure used to enclose the team bench during timeouts or other pauses in the game. The illustration shows the device in a collapsed form (101). The illustration shows the device in a partially expanded form with only the rear wall expanded (102). The illustration shows the device in its fully expanded form with the left and right-side walls expanded (103).

Figure 2:
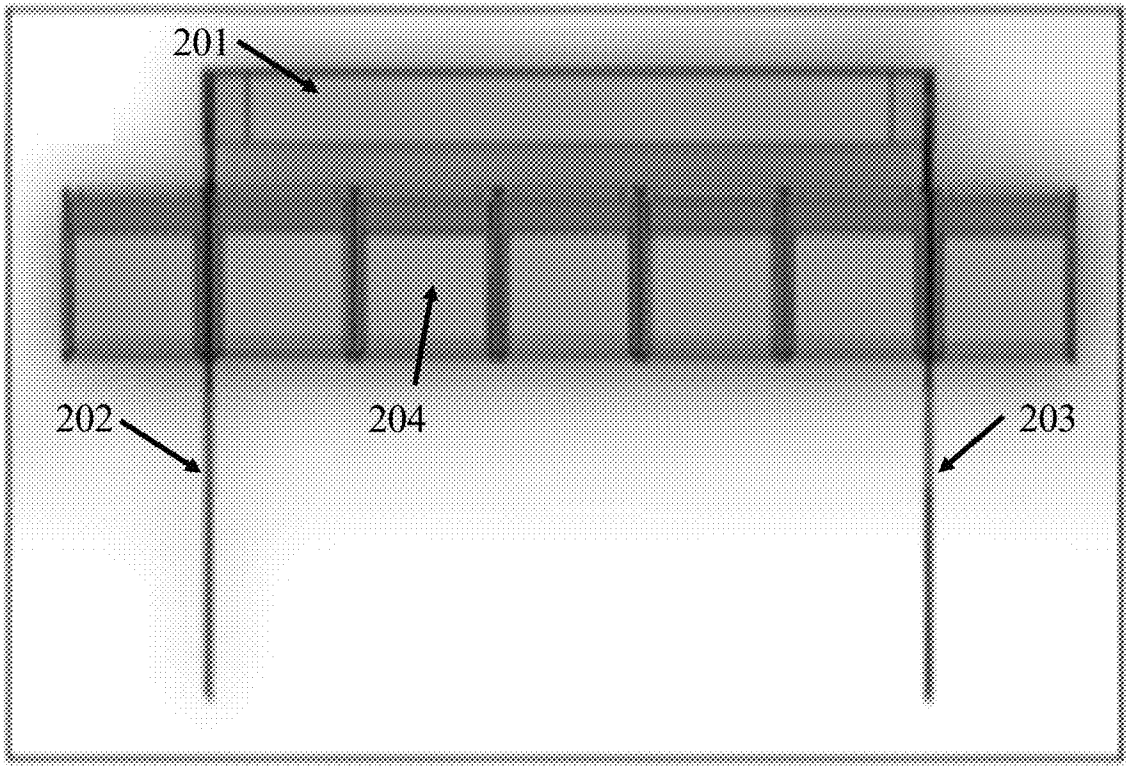
FIG. 2 is an exemplary illustration of a top view of the device used to enclose the team bench during timeouts or other pauses in the game.

FIG. 2 is an exemplary illustration of a top view of the structure used to enclose the team bench during timeouts or other pauses in the game. The illustration shows a top view of the rear wall of the device (201). The illustration shows a top view of the left and right-side walls of the device (202, 203). The illustration shows a top view of an exemplary team bench inside of the structure (204).

Figure 3:
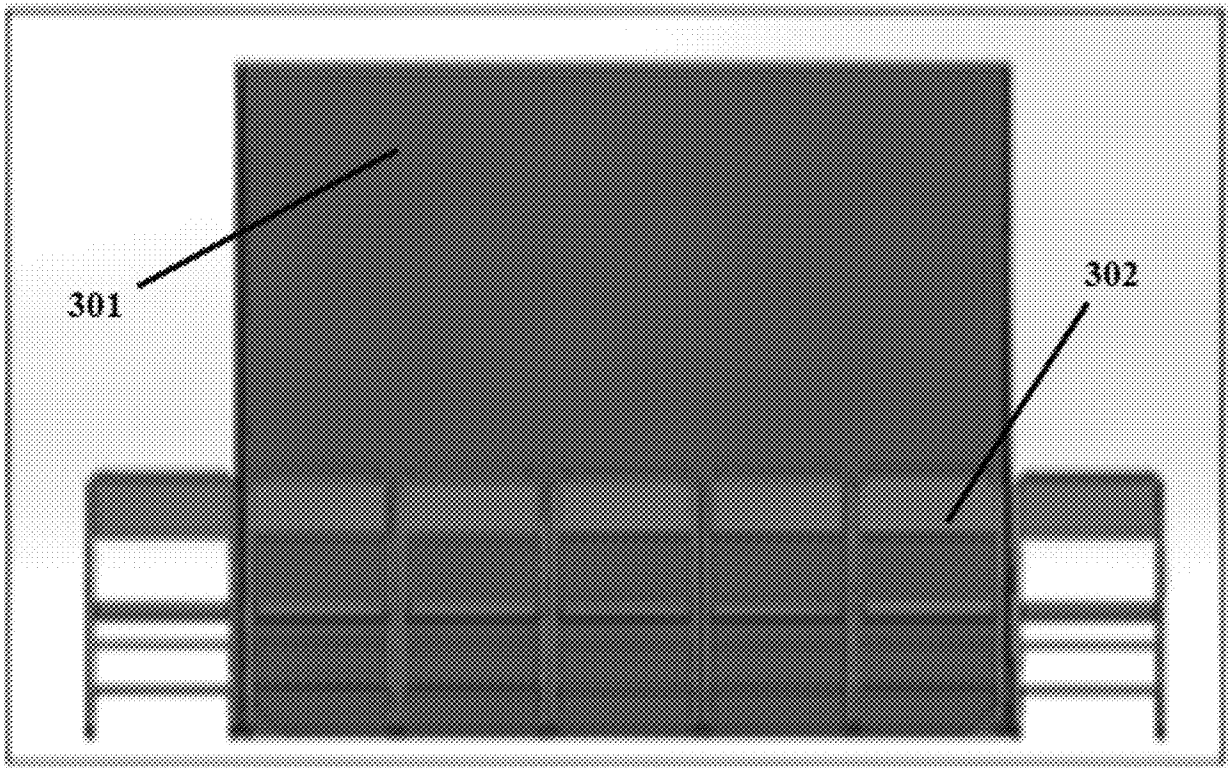
FIG. 3 is an exemplary illustration of a front view of the device used to enclose the team bench during timeouts or other pauses in the game.

FIG. 3 is an exemplary illustration of a front view of the structure used to enclose the team bench during timeouts or other pauses in the game. The illustration shows a front view of the rear wall of the device (301). The illustration shows a front view of an exemplary team bench inside the device (302).

FIG. 4 is an exemplary illustration of the poles (401-409) and pin bracket (410) inside of the walls used to support the enclosure. The primary support pole (401) is the first pole that should be erected on both the left and right sides of the device. The poles (402-409) provide the structural support for the left and right-side walls. The poles (401-409) can be held in place by the pin bracket (410). The pin bracket (410) can be made out of aluminum. The pin bracket features pin bracket spacers (411-412).

FIG. 5 is an exemplary illustration of the device in its expanded form. FIG. 5 depicts the front of the device from a diagonal view. The auditory and/or visual privacy can be provided by opaque, sound-reducing fabric (501).

FIG. 6 is an exemplary illustration of the device in its expanded form. In FIG. 6, the left-side wall (601) is depicted. The left-side wall can be a quarter-circle. The left-side wall can be comprised of opaque, sound-reducing fabric.

FIG. 7 is an exemplary illustration of the device in its expanded form. In FIG. 8, the rear wall (701) is depicted. The rear wall can be rectangular in shape. The rear wall can be comprised of opaque, sound-reducing fabric.

FIG. 8 is an example of the base (801) of the device. The base can expand to various widths.

FIG. 9 is an example of the base (901) of the device. The base can expand to various widths.

FIG. 10 is an example of the storage container that houses the device.

Figure 11:
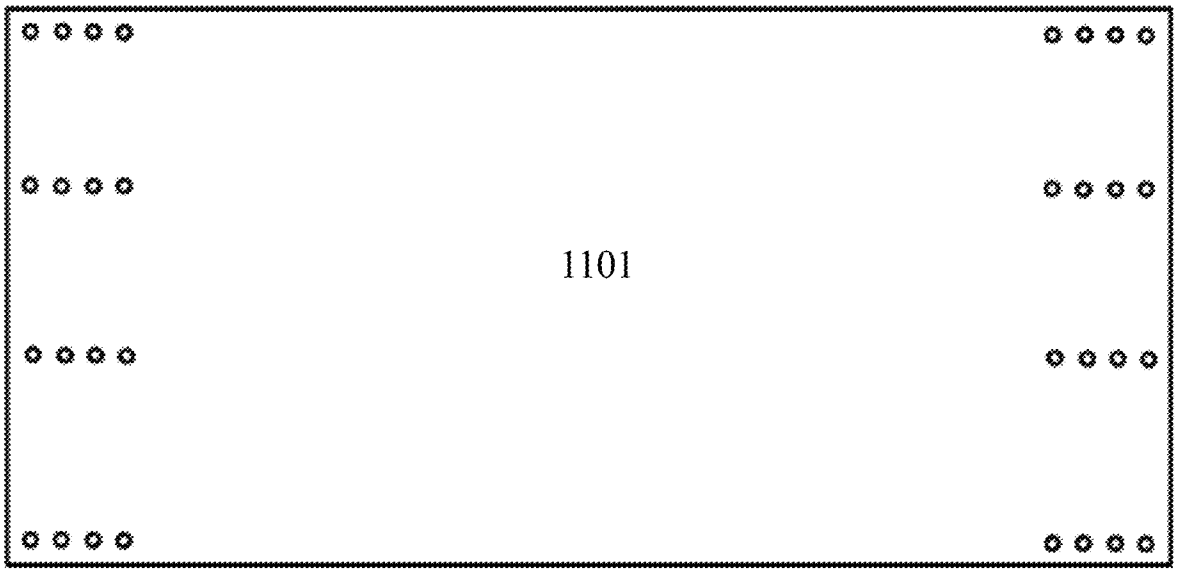
FIG. 11 is an exemplary illustration of the rear wall of the device in an expanded form.

FIG. 11 is an exemplary illustration of the rear wall of the device (1101). The illustration depicts the rear wall in its expanded form.

Figure 12:
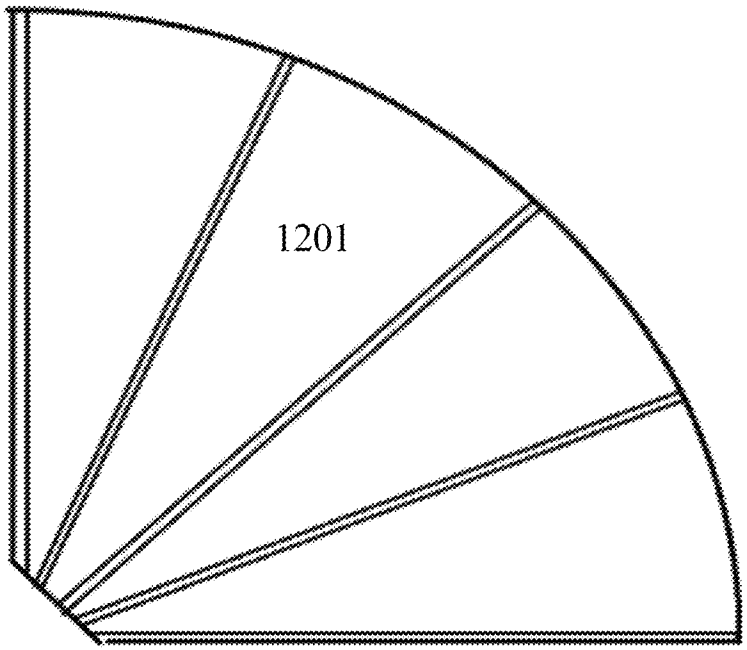
FIG. 12 is an exemplary illustration of the side walls of the device in an expanded form.

FIG. 12 is an exemplary illustration of the side wall of the device (1201). The illustration depicts the side wall in expanded form.

The invention claimed is:

1. A collapsible and portable barrier system comprising:

a housing;

a fabric;

a right-side primary support pole connected to a right side of said housing;

a left-side primary support pole connected to a left side of said housing;

wherein in a closed configuration, said right-side primary support pole said left-side primary support, and said fabric collapse into said housing; and wherein in a deployed configuration, said right-side primary support pole is in a position perpendicular to said housing; said left-side primary support pole is in a position perpendicular to the housing; and said right-side primary support pole and said left-side primary support pole are configured to hold said fabric upright to form a rear wall.

2. The collapsible and portable barrier system of claim 1, further comprising said rear wall capable of reducina visibility.

3. The collapsible and portable barrier system of claim 1, further comprising:

a left side skeletal pole connected to a left side of said housing;

a left sidewall fabric;

a right side skeletal pole connected to a right side of said housing;

a right sidewall fabric; and in said deployed configuration, said left side skeletal pole is about perpendicular to said left side primary support pole and said housing and said left sidewall fabric is stretched between said left side skeletal pole and said left side primary support pole to form a left sidewall on said left side of said housing;

in said deployed configuration, said right side skeletal pole is about perpendicular to said right side primary support pole and said housing and said right sidewall fabric is stretched between said right side skeletal pole and said right side primary support pole to form a right sidewall on said right side of said housing.

4. The collapsible and portable barrier system of claim 3, further comprising said housing haying a left housing and a right housing that are separable in said deployed configuration such that said left housing and said right housing can be placed apart and wherein in said closed configuration said right-side primary support pole and said left side skeletal pole collapse into said right housing and said left-side primary support pole and said left side skeletal pole collapses into said left housing.

5. The collapsible and portable barrier system of claim 1, further comprising said housing comprising a left housing and a right housing that are separable in said deployed configuration such that said left housing and said right housing can be placed apart; and wherein in said closed configuration said right-side primary support pole collapses into said right housing and said left-side primary support pole collapses into said left housing.

6. The collapsible and portable barrier system of claim 1, further comprising said housing containing a left housing and a right housing, wherein in said deployed configuration said right housing and left housing can be placed apart.

7. The collapsible and portable barrier system of claim 1, further comprising said housing containing a left housing and a right housing, wherein in said deployed configuration said right housing and left housing can be placed apart and secured using a system of pins.

8. The collapsible and portable barrier system of claim 1, further comprising said housing having one or more wheels or one or more handles.

9. The collapsible and portable barrier system of claim 1, further comprising said rear wall capable of reducing noise.

10. The collapsible and portable barrier system of claim 1, further comprising:

a left plurality of skeletal poles positioned at an angle between said left primary support pole and said left side skeletal pole and said left plurality of skeletal poles are connected to said left sidewall fabric; and a right plurality of skeletal poles positioned at an angle between said right primary support pole and said right side skeletal pole and said left plurality of skeletal poles are connected to said right sidewall fabric.

11. A collapsible and portable barrier system comprising:

a right-side primary support pole, a left-side primary support pole, a left side skeletal pole, and a right side skeletal pole;

in a deployed configuration, said right side primary support pole and said left side primary support pole are positioned upright apart from each other to hold a fabric between them to form a rear wall;

in said deployed configuration, said left side skeletal pole is about perpendicular to said left side primary support pole and a left sidewall fabric is stretched between said left side skeletal pole and said left side primary support pole to form a left sidewall, and said left sidewall and said left skeletal pole are foldable with respect to said left side primary support pole around a single point; and in said deployed configuration, said right side skeletal pole is about perpendicular to said right side primary support pole and a right sidewall fabric is stretched between said right side skeletal pole and right left side primary support pole to form a right sidewall, and said right sidewall and said right skeletal pole are foldable with respect to said right side primary support pole around a single point.

12. The collapsible and portable barrier system of claim 11, further comprisinsz a housing wherein said left-side primary support pole, said right side primary support pole, said right side skeletal pole, said left side skeletal pole, said left sidewall fabric, said right sidewall fabric, and said fabric can collapse into.

13. The collapsible and portable barrier system of claim 12, wherein said housing comprises one or more wheels or one or more handles.

14. The collapsible and portable barrier system of claim 11, further comprising said left side skeletal pole connected to said left-side primary pole by a left side pin bracket and said right side skeletal pole is connected to said right-side primary pole by a right side pin bracket.

15. The collapsible and portable barrier system of claim 11, further comprising said fabric wherein any or all of said left wall, said right wall, and said rear wall reduce noise.

16. The collapsible and portable barrier system of claim 11, wherein at least one of said left wall, said right wall, and said rear wall reduce visibility.

17. The collapsible and portable barrier system of claim 11, further comprising said left side skeletal pole connected to said left-side primary pole by a left side pin bracket, and spacing between the left-side skeletal pole and left-side primary pole can be adjusted using a left side pin bracket spacer; and said right side skeletal pole connected to said right-side primary support pole by a right side pin bracket and spacing between the right-side skeletal pole and right-side primary pole can be adjusted using a right side pin bracket spacer.

18. The collapsible and portable barrier system of claim 11, further comprising a first stand connected to said left primary support pole and a second stand connected to said right primary support pole.

19. The collapsible and portable barrier system of claim 11, further comprising a stand and said left primary support pole connected to said right primary support pole.

20. The collapsible and portable barrier: system of claim 11, further comprising:

a left plurality of skeletal poles positioned at an angle between said left primary support pole and said left side skeletal pole and said left plurality of skeletal poles are connected to said left sidewall fabric; and a right plurality of skeletal poles positioned at an angle between said right primary support pole and said right side skeletal pole and said left plurality of skeletal poles are connected to said right sidewall fabric.

* * * * *